United States Patent [19]
Weber et al.
[11] 4,292,829
[45] Oct. 6, 1981

[54] PROCESS FOR THE PRODUCTION OF METALLIC FORMED MEMBERS

[75] Inventors: Adolf Weber, Neunkirchen; Siegfried Rhau, Nuremberg, both of Fed. Rep. of Germany

[73] Assignee: Diehl GmbH & Co., Fed. Rep. of Germany

[21] Appl. No.: 95,564

[22] Filed: Nov. 19, 1979

[30] Foreign Application Priority Data

Dec. 6, 1978 [DE] Fed. Rep. of Germany ..... 2852658

[51] Int. Cl.[3] ..... B21J 7/16; F42B 13/48; B21J 7/18

[52] U.S. Cl. ..... 72/76; 428/554; 428/558; 102/492

[58] Field of Search ..... 102/67; 428/554, 558; 72/76

[56] References Cited

U.S. PATENT DOCUMENTS

| | | | |
|---|---|---|---|
| 3,652,235 | 3/1972 | Manilla et al. | 428/554 |
| 3,815,504 | 6/1974 | Tieben | 102/67 |
| 3,976,434 | 8/1976 | Schwayder | 428/558 |
| 3,982,904 | 9/1976 | Nayar | 428/554 |
| 4,032,335 | 6/1977 | Zapf et al. | 102/67 |
| 4,129,061 | 12/1978 | Bedall et al. | 102/67 |

*Primary Examiner*—Brooks H. Hunt
*Attorney, Agent, or Firm*—Scully, Scott, Murphy & Presser

[57] ABSTRACT

A process for producing a formed member, and a formed member which includes spherical fragments embedded in a metallic matrix is effected through cold annular or round forming. The spheres are arranged in the interspace between a basic support member, which may be a thin-walled inner casing, and an outer casing. Working of the outer casing causes the material of the support member and the outer casing to be pressed into the spaces between the spheres, densifies the support member and the outer casing, and prestresses the outer casing and spheres, thus allowing the inner casing to be extremely thin-walled. The prestressing of the spheres and outer casing, together with the inner casing imparts a high degree of energy to the casing fragments and to the spheres, affords economies in manufacture and a substantial increase in fragmenting energy at detonation of the formed member.

1 Claim, 5 Drawing Figures

PROCESS FOR THE PRODUCTION OF METALLIC FORMED MEMBERS

BACKGROUND OF THE INVENTION

1. Field of the Invention

The present invention relates to a process for the production of metallic formed members which include discrete particles embedded in a metallic matrix.

2. Description of the Prior Art

From the disclosure in German Patent Specification No. 24 60 013 there has become known a process for the production of formed or molded members which include discrete particles embedded in a metallic matrix. These particles are fastened to a metallic support and enveloped by a matrix which is constituted of a metallic powder. The support or carrier is isostatically pressed together with the particles and the enveloping material and thereafter sintered. The fragmentation bodies for projectiles which are produced pursuant to this process evidence a good fragmentation effect. However, the production of this fragmentation casing is complex from an economic standpoint since after the sintering, there will frequently be present unevenesses to the extent of a number of millimeters in the outer casing, which must be removed through a turning or machining operation. In order to be able to maintain the contemplated caliber size, the rough outer diameter of the fragmentation shell must, as a result, be selected of a relatively large size so as to be able to obviate that type of drawback. The extent of the machining on the fragmentation casing is thus relatively high. In addition thereto, the desired fragmentation effect cannot be reproduced in each instance since the matrix is forced at different depths into the interspaces between the particles during the pressing operation.

It is also disadvantageous that the sintering operation can adversely influence the metallurgical properties of the employed materials, such as the hardness or ductility. Moreover, the mentioned thermal process limits the number of materials which can be considered for the discrete particles.

Furthermore, from German Patent Specification No. 21 29 196 there has also become known a fragmentation body for fragmentation projectiles. Spherical fragments are filled in between two tubular members which are arranged within each other. Through high-pressure forming of the inner tubular member, the latter is pressed into the hollow interspaces between the fragments. Consequently, the tubular members are prefragmented and sandwiched together with the fragments into a fragmentation casing or shell. The high-pressure forming can be carried out in a shock-like manner, for example, through explosive shaping or electromagnetically, or also through pressing by means of a calibrating bolt.

A forming operation of that type is subject to the drawback in that, due to the degree of deformation which extends over too large a rolling width, the fragmentation effect is not reproducible to the required measure in that, because of the deformation force which cannot be uniformly distributed over the fragmentation casing, there will occur extremely high specific surface pressures which will fracture the spheres constituted, for instance, of hardened steel, such as ball bearing steel, and which will cause the deformation of the material of the inner casing beyond its ultimate tensile limits so as to cause a previously unpredictable reduction in the tensile strength. This reduction will also adversely affect the fragmentation effect.

SUMMARY OF THE INVENTION

Accordingly, it is an object of the present invention to provide a formed member for fragmentation projectiles which can be economically produced and which possesses a reproduceable fragmentation effect.

The foregoing object is inventively achieved for a formed member of the above-mentioned type in which the discrete particles are located between a metallic support member and a metallic outer casing, and wherein they are embedded into the support member as well as into the outer casing through annular cold molding of the outer casing, and in which shaping wedges or jaws will concurrently, but gradually work over the entire length of the outer casing, in conformance with the length of the particle arrangement as viewed in the axial direction of the formed member during the rotation of the formed member.

Through the invention there is thus advantageously achieved that, through the deformation of the outer casing, stresses will be produced in the outer casing which, in combination with the compressive stress in the spheres, will produce a significant increase in the fragmentation energy in the particles and in the outer casing fragments. The inner casing can thereby be extremely thin so that, upon detonation of the inserted explosive, the least possible energy must be expended for the deformation of the inner casing and the highest possible energy is transmitted through the fragmented inner casing to the particles. By means of the externally applied deformation force, through the outer casing and the particles, which are present in a form of spheres or balls, there is thus effected a deformation of the inner casing. This will effect a cold bonding in the region of the hemispherical identations formed by the spheres. The particles are thereby molded into the basic support member in a radial direction and therefore provide in these regions zones of higher hardness, and resultingly a higher tensile strength, between which there are narrow zones of lower tensile strength. The zones of lower tensile strength determine the fragmentation. Consequently, less energy is required for fragmentation then would be for an inner casing of a uniformly higher tensile strength. The volume of voids between the basic support member and the outer casing and the particles is minimized and, as a result, there is available a high mass and, in effect, a specialized mass of high density, as an energy carrier. Through the deformation there are present formed members which will be possessing a high dimensional precision and imbued with an excellent concentricity, meaning, the extent of any machining is extremely small and the static and dynamic imbalances significant with regard to accurate impact against a target are negligibly small. The discrete particles are reproduceably pressed against each other and will, in a defined manner, be shaped within the elastic range, or within the elastic range and within the plastic range. Hereby, the particles which are essential for the fragmentation of the outer casing will transmit the detonation energy completely within the range of their being molded into the outer casing since, in the same manner, there is present a zonal increase in the tensile strength as in the inner casing. The material of the outer and inner casings, pursuant to the caliber of the formed member, will encompass the particles up to about 70% of the particle surfaces and, as a result, during detonation the particles will be subjected to a relatively low specific surface pressure and will not be destroyed. Furthermore, the collective components of the formed member can be cold formed, for which a large number of materials are suitable for processing, even such as bonded materials. Through the cold forming the hardness of the discrete particles is not subjected to any changes inasmuch as no thermal loads are present. Notwithstanding the cold deformation of the discrete particles constituted of hardened steel, heavy metal or enriched uranium, surprisingly it is not absolutely necessary to have a spacing pattern since, due to the embedding of the spheres up to about 70% through a material of the inner and outer casing, there will not occur any fracturing of the particles during plastic deformation. However, contrastingly, for particles of hard metal it is necessary to provide a spacing pattern since that material is not plastically deformable.

The spacing pattern is absolutely necessary for spheres consisting of hard metal, since hard metal is not deformable. Hereby, the spacing pattern guarantees the desired embedding of the spheres into the material of the encompassing components, without that the hard metal spheres will be destroyed.

For spheres or balls of heavy metal, hardened steel or alloyed steel which are deformable within predetermined bounds, by means of the spacing it is possible to achieve a still better degree of embedding than without the spacing pattern. The spheres are first pressed against each other after the reaching of a predetermined degree of embedding. This will render it possible that, after the mutual contacting of the spheres or balls, the formed member may still be additionally deformed so as to attain a still higher degree of embedding.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
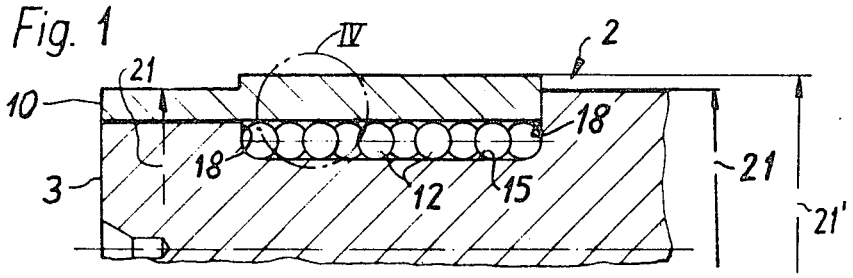
FIG. 1 generally schematically illustrates in section a formed member in its initial condition together with a basic support member.

With specific reference to the accompanying drawings, in the various figures the reference numeral 1 identifies an arrangement for round forming or shaping, 2 is a formed member 3 a basic support member, 4 a rotating clamping head, 5 a mandrel holder, 6 a space, 7 a mandrel, 8 forming wedges, 10 an outer casing or shell of type C 45 steel, 11 an inner casing or shell of type C 45 steel, 12 hardened spheres or balls constituted of ball bearing steel type 100Cr6, 13 and 14 are pressure zones, 15 is a recess, 18 are stops, 19 forming surfaces, 20 a finished diameter, 21 a diameter, 22 spacing patterns, 22' spacers, 23 a spacing, 24 an inner surface, 25 initial part arc, and 27 finished part arc. The outer casing may also be constituted of a non-ferrous metal, such as brass or aluminum.

Clamped into the clamping head 4 of the only schematically illustrated arrangement 1 for round forming is the inner casing 11. This possesses a recess 15 for the balls 12 which is bounded by the stops or contact faces 18. The balls 12, the outer casing 10 and the inner casing 11 are radially supported by the stationary or conjointly rotating mandrel 7.

The forming wedges 8 are each equipped with a concave forming or shaping surface 19 having a radius which generally corresponds to the finished diameter 20 (FIG. 5) of the outer casing 10. Provided in addition thereto are funnel-shaped surfaces 19'. In the axial direction of the formed member 2, the forming wedges are substantially shorter than the axially extending recess 15.

The diameters 21 of the basic support member 3 and the inner casing 11 corresponding to the finished diameter 20. 21' designates the rough diameter.

Figure 2:
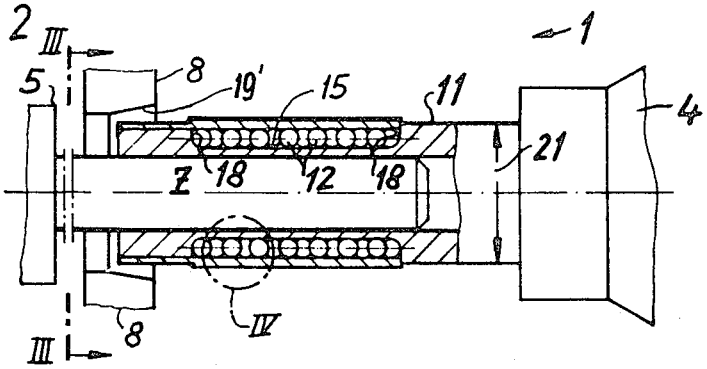
FIG. 2 illustrates a portion of an arrangement for the annular forming with a formed member and an inner casing.
Figure 3:
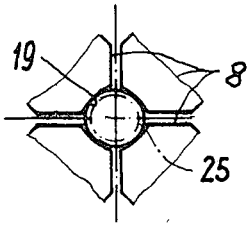
FIG. 3 is a fragmentary sectional view taken along line III—III in FIG. 2.
Figure 4:
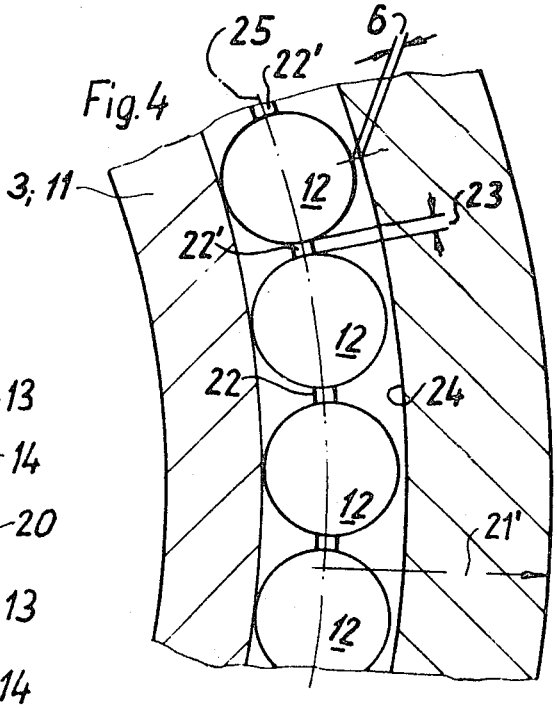
FIG. 4 is an enlarged sectional view taken in the encircled portion IV in FIG. 1, without the forging wedges or mandrel.

When in lieu of the inner casing 11 of FIG. 2 there is present the basic support member 3 pursuant to FIG. 1, then the latter is fastened to the clamping head 4. Located oppositely thereto and engaging against the basic support member 3 is a mandrel from the arrangement or an end retainer (not shown).

Figure 5:
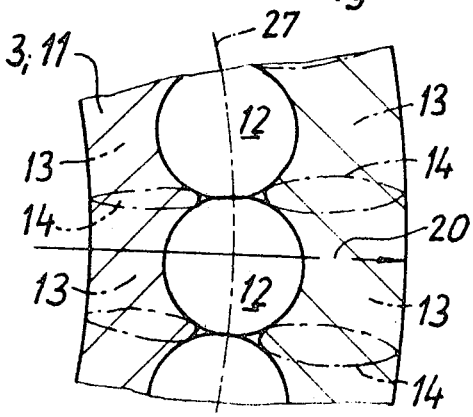
FIG. 5 is a sectional view similar to that of encircled portion IV as in FIG. 3 in the finished condition.

After the outer casing 10 is slid over the spheres which lie in a spacing pattern 22 with compressible spacers 22' at a spacing 23 and is assembled in the arrangement 1, there is then effected the known shaping operation. Hereby, the forming wedges 8 impact concurrently against the rotatably driven formed member 2 in accordance with FIGS. 1 and 2. Initially, the spacing 6 is reduced to zero in that the inner surface 24 of the outer casing 10 is pressed against the spheres 12. The spheres will then mold themselves into the mentioned casings 10 and 11, or casing 10 and the basic support member 3 to an increasing measure until there is reached the final condition as is illustrated in FIG. 5. The distance 23 becomes zero since the initial part circle 25 during forging becomes a smaller finished part circle 27. The spheres 12 are pressed against each other, a compressive stress being formed among the spheres, and the material of the spacers 22' is displaced sideways.

The basic support member 3, or the inner casing 11 which is supported by the mandrel 7, in conformance with the degree of forming in of the spheres or balls, possesses zones 13 of higher tensile strength and zones 14 of lower tensile strength. The same holds true for the outer casing 10. In addition thereto, the outer casing 10 is imparted tensile stresses which are caused through the deformation of the spheres 12 within the elastic, or the elastic and plastic range. The spheres 12 are pressed during the shaping and store a portion of the deformation energy (compressive stress). After the forming, the spheres 12 transmit a portion of the compressive stress to the outer casing 10, and to a lower extent, to its base support (inner casing 11 or basic support member 3). This deformation energy which is assumed by the above mentioned components produce correspondingly large tensile stresses in these components. The tensile stresses are larger in the outer casing 10 than in the inner casing 11.

After the forming operation, the formed member 2 may, if required, be still slightly turned down and the basic support member 3 further worked in order to obtain a casing or shell corresponding to the inner casing 11 as shown in FIG. 2. Thereafter, further processing operations may be continued in order to be able to provide the formed member with the projectile components which are intended therefore.

What is claimed is:

1. In a process for the production of a formed member, including discrete particles embedded in a metallic matrix, the improvement comprising: arranging said particles intermediate a metallic basic support member and a metallic outer casing; embedding said particles in said basic support member and said outer casing through annular cold working of said outer casing; and having shaping wedges which extend along and over only a partial number of said particles concurrently work over the full length of said outer casing in conformance with the length of the particle arrangement along the axial direction of said formed member during rotation of said formed member.

* * * * *